US007191488B2

(12) United States Patent
Jonsson

(10) Patent No.: US 7,191,488 B2
(45) Date of Patent: Mar. 20, 2007

(54) DEVICE FOR SETTING UP CENTRAL VACUUM CLEANING INSTALLATIONS

(76) Inventor: Ake Jonsson, Tegnervagen 13, Gavle (SE) SE-802 67

( * ) Notice: Subject to any disclaimer, the term of this patent is extended or adjusted under 35 U.S.C. 154(b) by 206 days.

(21) Appl. No.: 10/270,661

(22) Filed: Oct. 16, 2002

(65) Prior Publication Data

US 2003/0070248 A1 Apr. 17, 2003

(30) Foreign Application Priority Data

Oct. 16, 2001 (SE) ..... 0103428

(51) Int. Cl.
*A47L 5/36* (2006.01)

(52) U.S. Cl. ..... 15/314; 15/326; 15/323; 15/328

(58) Field of Classification Search ..... 15/314, 15/315, 323, 327.1, 326, 301, 328
See application file for complete search history.

(56) References Cited

U.S. PATENT DOCUMENTS 3,027,587 A * 4/1962 Bierstock ..... 15/301
3,254,359 A * 6/1966 Coll ..... 15/323
3,543,325 A * 12/1970 Hamrick ..... 15/314
3,706,184 A * 12/1972 Tucker ..... 15/314
3,958,297 A 5/1976 Hukuba et al. ..... 15/315
3,977,037 A * 8/1976 Miyake et al. ..... 15/315
3,977,038 A * 8/1976 Hukuba et al. ..... 15/315
5,205,013 A * 4/1993 Lopes ..... 15/323
6,158,080 A * 12/2000 Schlapkohl ..... 15/314
6,330,732 B1 * 12/2001 Liu ..... 15/314
2001/0022009 A1 * 9/2001 Spearman ..... 15/314

FOREIGN PATENT DOCUMENTS

DE 1 628 685 1/1971
DE 195 28 184 A1 2/1996
DE 100 21 417 A1 1/2001

* cited by examiner

*Primary Examiner*—Theresa T. Snider
(74) *Attorney, Agent, or Firm*—Dilworth & Barrese LLP

(57) ABSTRACT

A device for simple setting up of stationary central vacuum cleaning installations in dwellings or the like. The device is in the form of a housing (6) with the purpose of accommodating a conventional vacuum cleaner (7) of the type that comprises an intake air inlet (22) to which a long suction hose (8) is connectable. Parts of the housing are detachable from the rest of the housing in order to enable adjustment of the vacuum cleaner in the interior of the housing. In the housing, an aperture (25) is formed for leading through the hose (8) to the vacuum cleaner, as well as an outlet.

17 Claims, 4 Drawing Sheets

DEVICE FOR SETTING UP CENTRAL VACUUM CLEANING INSTALLATIONS

PRIOR ART

Figure 1:
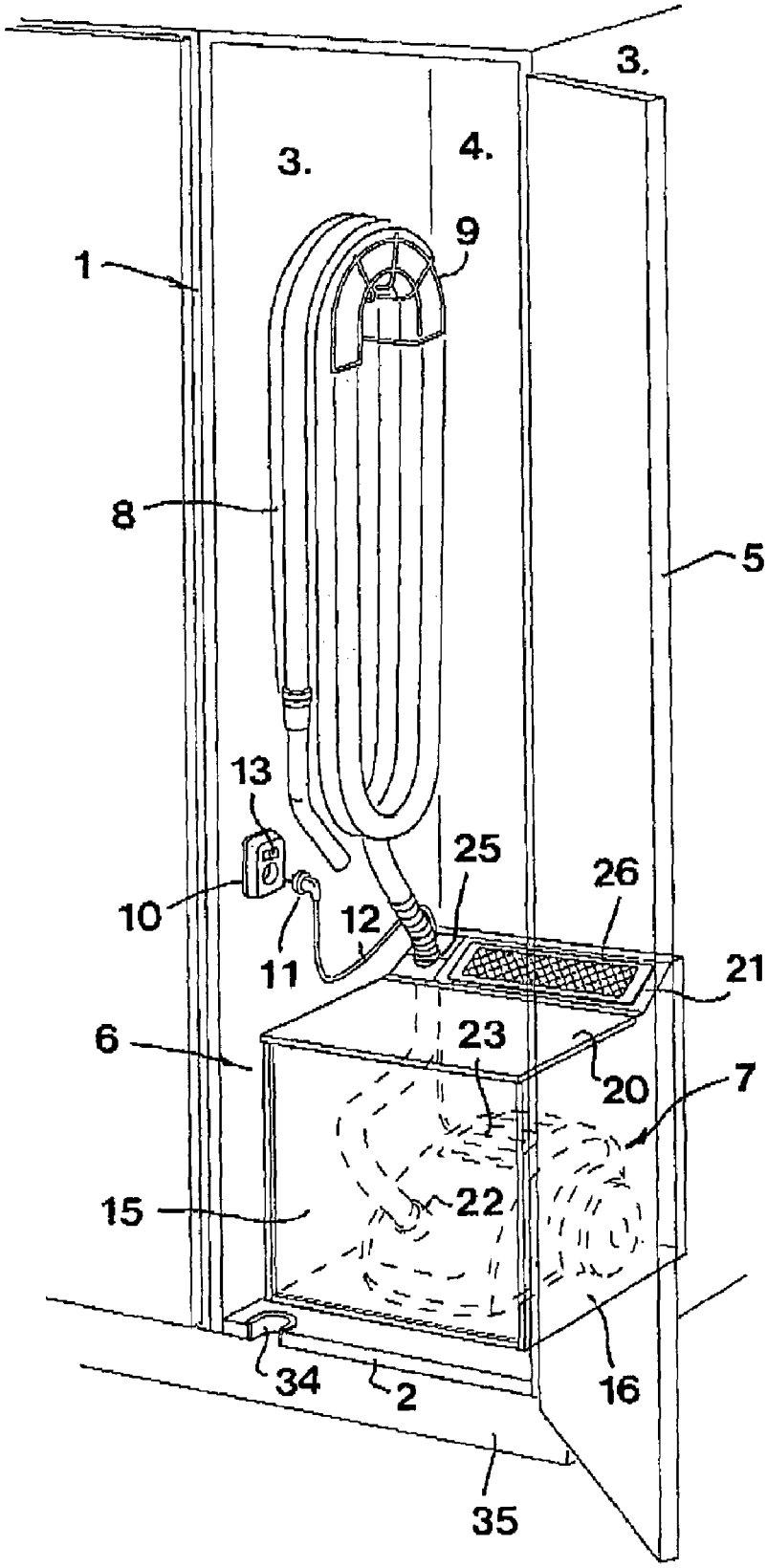

Vacuum cleaning in, for instance, dwellings, offices, hospitals, shops and industrial premises and the like has previously been effected by means of, above all, conventional, mobile vacuum cleaners of the type that includes a wheel-carried casing having a fan driven by an electric motor, which from a nozzle pipe and a hose sucks particle-mixed intake air through a replaceable bag in which the main part of the particles are caught before the air is forwarded to an exhaust air outlet, adjacent to which there is a fine filter having the desired filtration capacity, usually in the form of a so-called HEPA filter. The supply of the requisite power to the motor takes place via a flex having a male connector which can be applied into wall sockets of the type that are set out at different places in dwellings or other premises. Characteristic of such vacuum cleaners is, among other things, that the suction hose has a length (1.5–2 m) which is considerably shorter than the length of the flex (6–8 m). This means that the work to clean a floor requires continual moves of the vacuum cleaner between different small areas as long as the flex reaches up to one and the same wall socket, as well as more rarely occurring shiftings of the male connector of the flex between different wall sockets. Disadvantages of conventional vacuum cleaners is not only the fact that the same require continual moves and intricate operation, but also that the same during the move thereof bump into and may damage, for instance, furniture, wall coverings and miscellaneous other objects which come in the way. Another disadvantage is that the vacuum cleaner has a weight of 5 to 8 kg and is, therefore, heavy and ungainly to move and to take out from and put back into, respectively, a cupboard. Furthermore, the conventional vacuum cleaner gives rise to relatively high noise levels, which primarily are annoying in the room where vacuum cleaning is carried out, but also in nearby rooms.

For the above-mentioned reasons, central vacuum cleaning installations have recently received a growing popularity. Such installations may be divided into two main categories, a first one of which is based on the intention to build in a piping system in the permanent parts of the building in question. More precisely, a vacuum source is set up at a suitable place to which permanent pipes are connected, which are built-in into the building framework and mouth into different apertures in the walls of the building. To said mouth apertures, a comparatively short, moveable hose may be connected with the ensuing holder pipe together with a suction nozzle.

The second category of central vacuum cleaning installations make use of an immobile, although loose suction apparatus to which a long hose (approx. 8 m) may be connected, the apparatus being siteable at a suitable central place in a dwelling in order to enable pulling-out of the long hose to different rooms at a distance from the siting.

A serious disadvantage of the first category of central vacuum cleaning installations is that the same only are suitable for new buildings. To afterwards build in a piping system in existing buildings is economically unrealistic. A disadvantage of the second category of installations is that the centrally placeable suction apparatus is fairly expensive and represents an extra cost for such households that already possess a conventional vacuum cleaner of the type initially mentioned. To invest in an expensive new suction apparatus in spite of possession of a fully working vacuum cleaner of a standard type restrains many households having a stretched economy from acquiring such central vacuum cleaning installations in spite of the same offering the attractive possibility of carrying out the vacuum cleaning work without the need of having to drag about an ungainly, mobile vacuum cleaner during all phases of the work.

Another disadvantage of the conventional vacuum cleaners of the mobile type as well as the above-described stationary central vacuum cleaning installations is that cleaning of the exhaust air which has passed the particle-capturing bag takes place in only one step. In practice, this means that the air that is let out in the dwelling areas always contains minor amounts of fine particles that have not been possible to capture by the bag and the simple filter. This means that if a suction apparatus of the above-mentioned second category would be set into a wardrobe or another closeable space, said space will, after a certain time of use, be mixed with annoying amounts of fine particles. Furthermore, the fact that minor amounts of fine particles are let out in the surroundings of the vacuum cleaner or suction apparatus implies inconveniences for, for instance, allergic persons.

OBJECTS AND FEATURES OF THE INVENTION

The present invention aims at managing the above-mentioned shortcomings and at providing prerequisites for individuals responsible for cleaning to, in a simple way, provide a central vacuum cleaning installation having an efficient air-cleaning without having to make major investments. Therefore, a primary object of the invention is to provide a device that makes it possible, after a simple exchange of hose, to utilize a conventional vacuum cleaner for central vacuum cleaning purposes. An additional object is to provide prerequisites for improving the quality of the exhaust air, among other things with the purpose of enabling set up and long-term storage of the vacuum cleaner in a closed crowded space without annoying dust formation arising therein. In particular, the device together with the vacuum cleaner should be possible to be set up in cleaning cupboards and wardrobes, respectively, having a limited width (60, 50 and 40 cm, respectively). Furthermore, the device should enable simple and convenient exchanges of particle separation bags as well as filters. Another object of the invention is to provide a device that efficiently insulates and suppresses the motor noise of the vacuum cleaner, not only in the room where vacuum cleaning is carried out, but also in all other rooms outside the siting of the vacuum cleaner.

According to the invention, at least the primary object is attained by the features given in claim 1. Preferred embodiments of the invention are furthermore defined in the dependent claims.

Additional Elucidation of Prior Art

To set up a conventional vacuum cleaner inside a close, parallelepipedic housing is known, per se, by DE 10 021 417. In this case, however, the external housing is mobile by including a set of wheels, which enables movement of the housing as well as the contained vacuum cleaner between different floor part surfaces. The vacuum cleaner built-in into the housing is still conventional in the sense that the hose connected to the holder pipe and the suction nozzle is short, i.e. has a limited radius of action from the housing. The object of building-in the vacuum cleaner into an outer housing is that unclean exhaust air from the vacuum cleaner should not come out into the indoor air. For this purpose, a very long exhaust air hose is connected to the housing which may be wound to and unwound from, respectively, a reel mounted on the roof of the housing, the hose being pulled out through a window or an outer wall of a building. In this way, from the vacuum cleaner the unclean exhaust air can be led out outdoors instead of being let out indoors. However, the device according to DE 10 021 417 does not form any central vacuum cleaning installation at all. With the exception of the exhaust air evacuation, praiseworthy per se, the device therefore works in the same cumbersome and ungainly way as a conventional, mobile vacuum cleaner.

BRIEF DESCRIPTION OF THE APPENDED DRAWINGS

Figure 3:
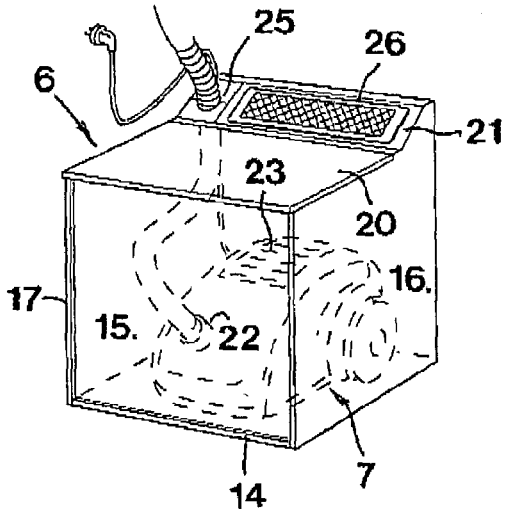
Figure 2:
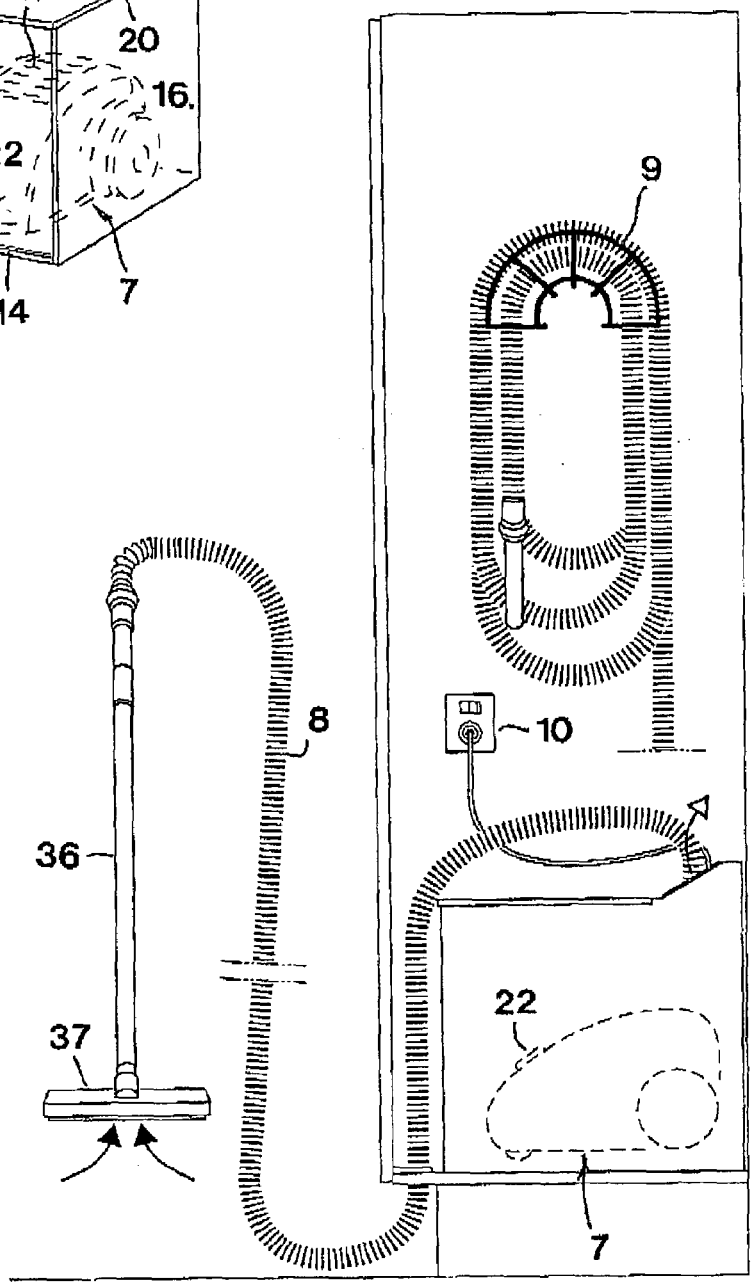
Figure 4:
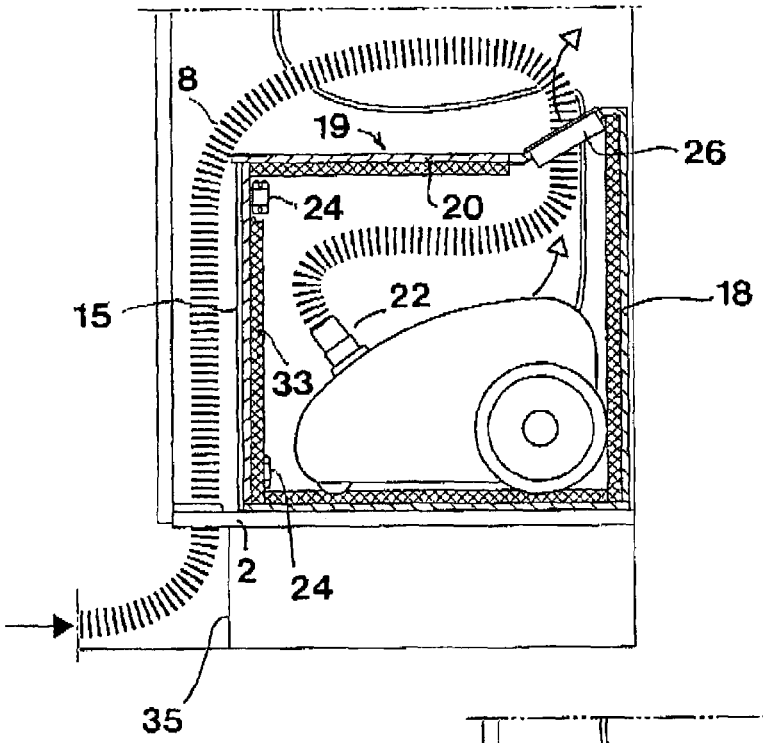
Figure 5:
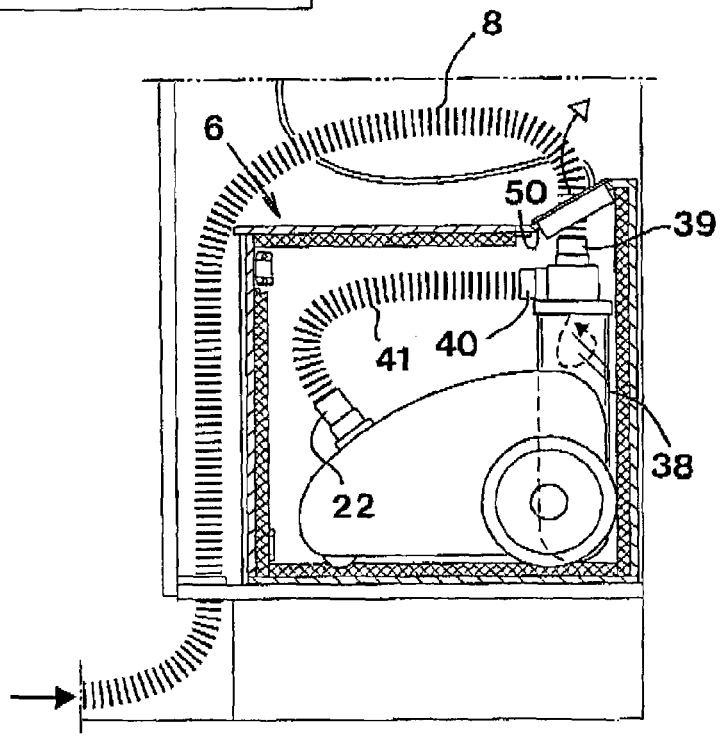
Figure 6:
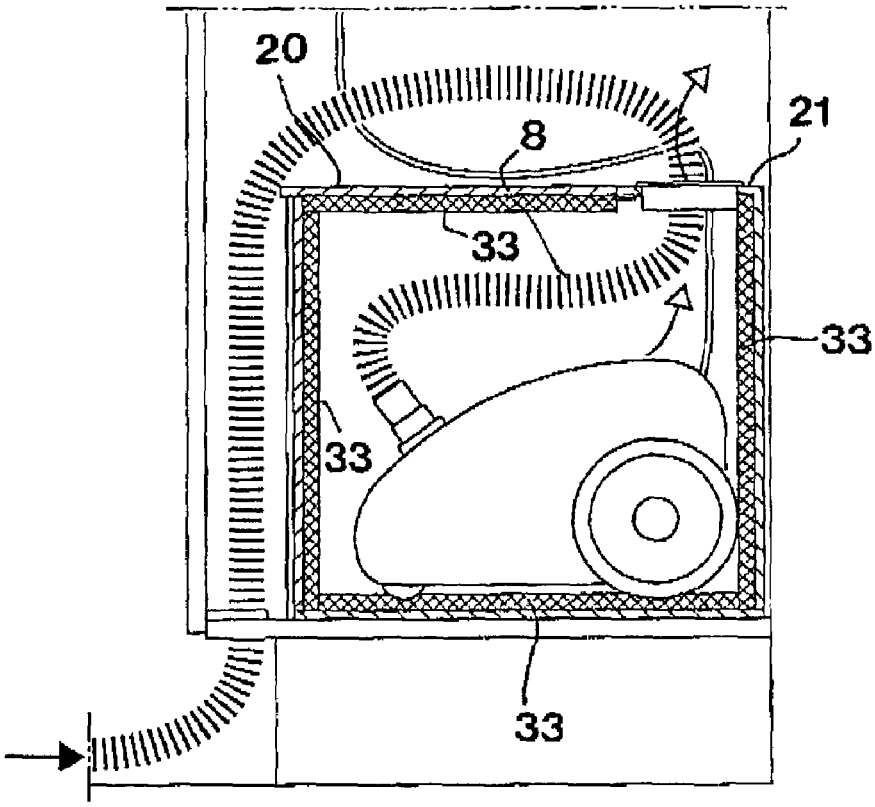
Figure 7:
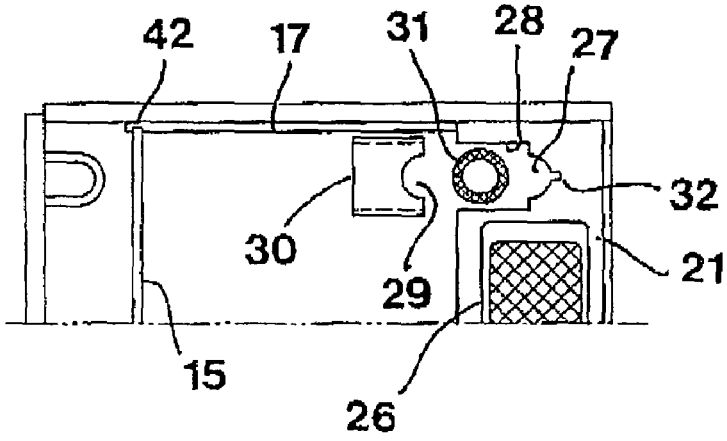

In the drawings:

FIG. 1 is a partly transparent perspective view showing a device according to the invention set up in a wardrobe, FIG. 2 is a side view of the same device showing an appurtenant suction hose pulled out from the wardrobe, FIG. 3 is a perspective view of just the proper device, FIG. 4 is an enlarged vertical section through the device, FIG. 5 is an analogous section showing an alternative embodiment of the device, FIG. 6 is a section showing an additional alternative embodiment of the device, and FIG. 7 is a partial planar view showing a detail of the device.

DETAILED DESCRIPTION OF PREFERRED EMBODIMENTS OF THE INVENTION

In FIG. 1, numeral 1 generally designates an existing cupboard, e.g. a cleaning cupboard, a wardrobe or the like. In addition to a bottom 2, two side walls 3, and a rear wall 4, the cupboard includes a front door 5. In the cupboard, a device made according to the invention is set up in the form of a housing generally designated 6. Inside said housing, a vacuum cleaner 7 of the conventional or an arbitrary type is located, outlined with dashed lines. To the vacuum cleaner 7, an extraordinary long hose 8 is connected, which may be hung up on a hose holder 9 that is fixedly mounted on one of the two side walls of the cupboard 3. On the same side wall of the cupboard as the hose holder 9, a female connector 10 may advantageously also be mounted in which a male connector 11 of an electric cable 12 may be applied. Said female connector 10 may advantageously include or cooperate with a disconnector switch button 13.

Now reference is also made to FIGS. 2–4, which more in detail illustrate a preferred embodiment of the housing 6. As is seen in said figures, the housing has a parallelepipedical basic shape and is formed from six boards of substantially plate-shaped parts, namely a bottom 14, a front piece 15, two side pieces 16, 17, a back piece 18 as well as a top in its entirety designated 19. In the shown embodiment example, the top 19 is composed of a detachable plate part 20, which covers the major part of an upper opening in the housing, as well as a narrower rear top portion 21, which is permanently and stiffly united with the two side pieces 16, 17. Advantageously, also the front piece 15 consists of a separately detachable plate part, while other parts of the housing, i.e. the bottom 14, side pieces 16, 17 and the back piece 18 are permanently united to each other (and with the top portion 21) while forming a form-stiff casing unit.

In the usual way, the vacuum cleaner 7 includes an intake air inlet 22 and an exhaust air outlet 23 through which the exhaust air from the vacuum cleaner is let out into the interior of the housing. Adjacent to said outlet 23, a primary filter or fine filter (not shown) is, in the common way, arranged, which filters the exhaust air when this has passed a bag (not shown) positioned in the interior of the vacuum cleaner in which bag dust and trash which accompany the intake air are captured. The construction of the vacuum cleaner is, however, not critical for the realization of the invention provided that the same includes at least a particle separator.

In the embodiment according to FIGS. 1–4, the detachable front plate 15 is connectable to the fixed casing unit of the housing by means of suitable coupling means 24, e.g. magnetic couplings or snap-in holders. Also the detachable top plate 20 may have particular coupling means, although in the drawings the same are shown just laid on the upper edges of the side pieces 16, 17.

In the fixed rear portion 21 of the top of the housing, an aperture 25 for leading through the suction hose 8 is formed as well as an opening 50 for the mounting of a secondary filter or fine filter 26. Said secondary filter 26 may consist of a HEPA filter or another suitable filter having a rectangular shape, and be mounted in a frame that may be snap-in fastened in an opening of a correspondingly rectangular shape in the top portion 21. The opening 50 generally serves as an outlet for letting out such exhaust air that has passed the vacuum cleaner and thereafter flowed out into the interior of the housing. In the preferred embodiment shown in the drawings the exhaust air is filtered a second time in the secondary filter 26 before it is let out in the open. In this context it shall be mentioned that the secondary filter may be dispensed with, the exhaust air being let out unfiltered through the outlet opening 50. It may also be mentioned that two or more filters, e.g. filters having different filtering capacity (such as coarse filtering, medium filtering and/or fine filtering) may be arranged in connection with the outlet opening.

Concerning the aperture for the hose 25, reference is made to FIG. 7, which illustrates how a first, semicircular concavity 27 is formed adjacent to a rear edge of a substantially rectangular recess 28 in the rear top portion 21. An analogous second concavity 29 is formed in a quadrangular recess piece 30, which is insertable in the recess 28. Together the concavities 27, 29 form a round aperture. Between the two concavities 27, 29, a collar-like, slotted seal 31 is shown, which may be applied outside the suction hose and form an air seal when the recess piece 30 is inserted into the recess 28. In connection with the first concavity 27, a narrow notch 32 is formed via which the electric cable 12 may be led out from the interior of the housing. When the seal 31 is pressed in place by the recess piece 30, an airproof screening is achieved not only between the pipe and the edge of the aperture but also against the electric flex applied in the notch 32.

On the inside of all six plates 14, 15, 16, 17, 18 and 20, which together form the housing 6, linings 33 of a sound-insulating material are applied, e.g. mats of porous rubber or fibre material. Said insulating linings guarantee a good sound screening against the motor noise of the vacuum cleaner, apart from the sound-insulating effect which is attained already by the fact that the vacuum cleaner is located inside the closed housing, which in turn is placed in the closed cupboard 1. In practice, the linings may be made of a flame-proof material, which not only has a good sound-insulating capacity, but also a rough or coarse surface structure. In this way, fine particles that have come to pass the bag and filter of the vacuum cleaner and that have been let out into the interior of the housing may be captured and brought to stick on the surface of the linings. This means that at least a certain part of the fine particles that have managed to escape into the interior of the housing are pre-separated before the exhaust air is cleaned in an additional step in the filter 26 and finally is let out from the housing.

In FIG. 1 is seen how a recess 34 for leading through the hose 8 may be formed in the part of the bottom 2 of the cupboard that projects a distance from a toe recess 35 under the cupboard. In other words, the door of the cupboard 5 may be closed without obstacle of the hose pulled out from the cupboard.

In FIG. 2 is shown how the hose 8 in a known way is connected to a holder pipe 36 having a flat suction nozzle 37. The length of the hose 8 may be within the range of 6–20 m, suitably 8–16 m. In this way, it is guaranteed that all rooms in an ordinary dwelling may be reached from an approximately centrally placed cupboard in the same. However, in all events, the length of the hose should not be below 5 m. It should further be mentioned that the inner diameter of the hose should be within the range of 20–70 mm, suitably 30–55 mm.

In the embodiment according to FIGS. 1–4 (as well as the embodiment according to FIG. 5), the rear, fixed portion of the top 21 is inclined upwards/backwards from the plate 20. By said obliquity, it is guaranteed that items which possibly fall down on the filter 26 slide down and out on the plate 20 in order not to choke up the filter. However, in the embodiment according to FIG. 6, the top portion 21 extends horizontally in the extension of the plate 20. It is also feasible to tilt the rear top portion—and thereby also the filter 26—in the direction downwards/backwards with the purpose of directing the outgoing flow of exhaust air through the filter obliquely upwards/backwards from the housing. Guiding of the flow of exhaust air may also be effected by means of suitable formed gratings in the opening 50.

In FIG. 5 is visualised how a particular cyclone separator 38 may be arranged inside the housing 6. Said cyclone separator, which has the purpose of separating coarse constituents from the incoming air has, at the upper part thereof, an inlet 39 to which the long hose 8 is connectable. Furthermore, an outlet 40 is included from which a short hose piece 41 extends to the ordinary inlet 22 of the vacuum cleaner 7. By the fact that coarse constituents in the incoming intake air are separated before admittance into the bag of the vacuum cleaner, the service life of the bag is extended considerably.

In the embodiment according to FIGS. 6 and 7, the front piece 15 is connected to the fixed side pieces 16, 17 of the housing casing unit by the fact that the side edges of the front piece are inserted into grooves 42 on the insides of the side pieces.

The Function and Advantages of the Device According to the Invention

Before the housing is set up in the cupboard 1, certain preparatory measures are taken, namely set up of the hose holder 9 and female connector 10 on a wall of the cupboard. In addition, the recess 34 is advantageously also formed in the bottom of the cupboard. After having taken said measures, the casing unit (i.e. the housing without the front piece 15 and the top plate 20) of the housing is put into the cupboard. In the next step, the vacuum cleaner 7, which may consist of the existing, working vacuum cleaner of the user, is put into the housing, and an extraordinary long hose 8 especially acquired for the purpose, which has been connected to the inlet of the vacuum cleaner, being hang up on the holder 9 in the way that is shown in FIG. 1. On the hose, the seal collar 31 is applied, and then the recess piece 30 is inserted into the recess 28 in the rear portion 21 of the top of the housing. After this, the housing may be sealed by application of the front piece 15 and the loose top plate 20. The device is now in a state to be used.

At vacuum cleaning, a suitable length of the hose is released from the holder 9 and is pulled out through and clamped in the recess 34 (in order to enable closing of the door 5 of the cupboard), and then the holder pipe 36 together with the nozzle 37 are moved between the different floor surfaces that should be cleaned. The vacuum cleaner is activated by switch-over of the disconnector switch button 13. After finalized vacuum cleaning, the door of the cupboard is opened, and then the hose is wound up again on the holder 9.

A substantial advantage of the device according to the invention is that the same enables modification of a conventional, working vacuum cleaner that already is in possession of the user, for the purposes of central vacuum cleaning. Thus, the user only needs to acquire the disclosed housing and a particular hose having a length (e.g. within the range of 8–16 m) adapted to the individual need. During the proper vacuum cleaning work, the vacuum cleaner works extraordinarily quiet. In practice, the motor noise from the vacuum cleaner will be hardly audible, neither in rooms located far away nor in the room immediately outside the cupboard, in that the vacuum cleaner is contained in the sound-insulating housing, which in turn is contained in the closed cupboard 1. Another substantial advantage is that the vacuum cleaner put into the housing may be kept and used for long inside a cupboard without giving rise to annoying dust formation inside the cupboard. Thus, the exhaust air from the vacuum cleaner is cleaned not only by the vacuum cleaner's own particle separator or filter, but also in one or more steps after that. Thus, fine particles that escape the vacuum cleaners inherent filter or particle separator can, to a large extent, be captured on the coarse, exposed surface of the internal sound-insulating lining 33, and get caught on the same. The remaining fine particles that accompany the exhaust air in the direction of the filter 26 will be separated by the same. In other words, only extremely clean exhaust air is let out of the housing. This means that other items, such as clothes, may be kept in the same cupboard as the vacuum cleaner without being covered with dust. In this connection, another advantage should be mentioned, namely that if a working vacuum cleaner would lack an efficient filter and the user, e.g. an allergic person, needs an extraordinary good air quality, a sophisticated, efficient filter 26 may be chosen in the housing. In this way, the proper vacuum cleaner does not need to be replaced. The large needs of allergic persons for good filtering may furthermore be guaranteed by the use of efficient filters in the vacuum cleaner as well as the housing. What is more, two or more filters may be arranged in the passage of the exhaust air out of the housing. Another advantage of the invention is that the housing does not have any projecting parts at all in that the bottom as well as the upright wall pieces consist of plane, smooth plates, all necessary details for the function of the vacuum cleaner, i.e. the suction hose, the flex and the filter, being located in the top of the housing. This means that the housing may be put also into slender cupboards having a narrow fit between the walls of the cupboards and wall pieces of the housing.

Feasible Modifications of the Invention

The invention is not solely limited to the embodiments described above and shown in the drawings. Thus, it is feasible to have only one access opening to the interior of the housing, e.g. an upper opening, which is coverable by a top plate or a lid. Furthermore, the leading through of the hose and the flex, respectively, through the housing may be realized in another way than by the solution shown in FIG 7. It should also be pointed out that shape of the housing may deviate from the exemplified, generally parallelepipedic shape. Also, the disclosed secondary filter (or the filters) may be placed at another place than in the top, although said location is to prefer. In this connection, it should be pointed out that it is possible to set up, in or adjacent to the housing, a suction fan in order to facilitate the evacuation of the exhaust air from the housing. Although it is preferred to permanently mount one or more secondary filters in the exhaust air outlet in the housing, it is feasible to deliver the housing without any such filters. Then, the user may at his or her own discretion either use the device without filters or supplement the outlet with a suitable filter. Furthermore, the capacity of the housing or sound-insulating lining to internally capture fine particles may be additionally improved by application of a replaceable film having a sticky surface having an extraordinary good particle-capturing capacity. If the cyclone separator shown in FIG. 5 cannot be built-in into the interior of the housing, the same may also be placed on the outside of the housing. Finally, it should be mentioned that the long hose not necessarily has to be directly connected to the intake air inlet of the vacuum cleaner. Thus, it is feasible to bring out, through the aperture 25 in the housing, a stiff pipe or another connection device to which the suction hose is connected at a point outside the housing.

The invention claimed is:

1. Device for setting up a central vacuum cleaning installation, comprising a housing releasably enclosing a vacuum cleaner, the vacuum cleaner within the housing having an intake air inlet, a suction hose connected to the air inlet, an air outlet and a particle separator, at least a portion of the housing being separable from the rest of the housing in order to uncover at least one opening through which the vacuum cleaner may be placed into and removed from the interior of the housing, the housing having an aperture in which the hose or a connection device therefor is retained, the housing having an outlet for air from the outlet of the vacuum cleaner, and a cyclone separator (38) being arranged inside or outside the housing and having an inlet (39) to which a hose (8) is connectable and an outlet (40) which via a hose piece (41) is connectable to the intake air inlet (22) of the vacuum cleaner.

2. Device for setting up central vacuum cleaning installations, comprising a housing (6) structured and arranged to both contain and secure a mobile vacuum cleaner (7) therewithin and allow the vacuum cleaner (7) to be removed therefrom, with the mobile vacuum cleaner (7) having an air intake inlet (22) coupled to a suction hose (8), an exhaust air outlet (23) arranged to exhaust air into an interior of said housing and at least one particle separator situated therewithin to remove particles from incoming air suctioned through the suction hose (8) and air intake inlet (22) prior to being exhausted through the exhaust air outlet (23), a detachably-mounted part (15, 19) upon said housing (6) and structured and arranged to allow the vacuum cleaner (7) to be inserted and retained within said housing (6) for central vacuuming use or removed from said housing (6) to permit operation independently of said housing (6) when detached therefrom, a first aperture (25) arranged through said housing (6) to allow either the suction hose (8) or a connection therefor to be lead through said first aperture (25) and coupled at one end to the air intake inlet (22) of the vacuum cleaner (7) when the vacuum cleaner (7) is situated within said housing (6) and extending out of said housing (6) at an opposite end for central vacuuming through the opposite end, and a second opening (50) arranged through said housing (6) to direct air exhausted through the exhaust air outlet (23) of the interior of the vacuum cleaner (7) out of said housing (6) when the vacuum cleaner (7) is both operated and situated within said housing (6).

3. The device of claim 2, additionally comprising at least one filter (26) arranged upon said second opening (50) to additionally filter the air exhausted through the exhaust air outlet (23) of the vacuum cleaner (7) and which has been filtered in the particle separator of the vacuum cleaner (7).

4. The device of claim 3, wherein said housing (6) has a shape of a parallelepiped formed by bottom (14), front (15), two side (16, 17), back (18) and top (19) plate-shaped pieces.

5. The device of claim 2, wherein said housing (6) additionally comprises an interior lining (33) of sound insulating material.

6. The device of claim 2, wherein said housing (6) defines a single interior chamber containing the vacuum cleaner (7) and all attached accessories.

7. The device of claim 2, wherein said second opening (50) is positioned directly above the exhaust air outlet (23) when the vacuum cleaner (7) is positioned within said housing (6).

8. A device for setting up central vacuum cleaning installations, comprising a housing (6) structured and arranged to both contain and secure a mobile vacuum cleaner (7) therewithin and allow the vacuum cleaner (7) to be removed therefrom, with the mobile vacuum cleaner (7) having an air intake inlet (22) to receive a suction hose (8) coupled thereto, an exhaust air outlet (23) and at least one particle separator situated therewithin to remove particles from incoming air suctioned through the air intake inlet (22) prior to being exhausted through the exhaust air outlet (23), a detachably-mounted part (15, 19) upon said housing (6) and structured and arranged to allow the vacuum cleaner (7) to be either inserted into or removed from said housing (6) when detached therefrom and retain the vacuum cleaner (7) within said housing (6) when mounted thereon, a first aperture (25) arranged through said housing (6) to allow either the suction hose (8) or a connection therefor to be lead therethrough and coupled to the air intake inlet (22) of the vacuum cleaner (7) when the vacuum cleaner (7) is situated within said housing (6).

a second opening (50) arranged through said housing (6) to direct air exhausted through the exhaust air outlet (23) of the vacuum cleaner (7) out of said housing (6) when the vacuum cleaner (7) is both operated and situated within said housing (6), and at least one filter (26) arranged upon said second opening (50) to additionally filter the air exhausted through the exhaust air outlet (23) of the vacuum cleaner (7) and which has been filtered in the particle separator of the vacuum cleaner (7), wherein said housing (6) has a shape of a parallelepiped formed by bottom (14), front (15), two side (16, 17), back (18) and top (19) plate-shaped pieces, and said first aperture (25) and filter (26) are arranged adjacent one another in a rear portion (21) of said top piece (19) and which is permanently united with said side pieces (16, 17).

9. The device according to claim 8, wherein said top piece (19) additionally comprises a separate, detachably-mounted plate part (20) arranged to cover an opening through the top of said housing (6) and which forms part of said detachably-mounted part (15, 19) upon said housing (6).

10. The device of claim 9, wherein said rear portion (21) of said top piece (19) comprises a recess (28), and said first aperture (25) is formed by a first concavity (27) in said rear portion (21) of said top piece (19) adjacent said recess, and a second concavity (29) arranged upon a separate piece (30) arranged to be insertable into said recess (28).

11. The device of claim 10, additionally comprising a notch (32) arranged upon said first concavity (27) for leading an electric cord (12) from the vacuum cleaner (7) outside of said housing (6).

12. The device of claim 11, additionally comprising a seal (31) arranged to be pressed in place between said first (27) and second (29) concavities by said separate piece (30) to provide airproof sealing around both the hose (8) and electric cord (11) of the vacuum cleaner (7) lead through said first aperture (25).

13. The device of claim 9, wherein said bottom (14), back (18) and side (16, 17) pieces are also permanently-united to each other to form a stiff casing unit (6), and said front piece (15) is detachably-mounted upon said stiff casing unit (6) and forms part of said detachably-mounted part (15, 19) upon said housing (6).

14. The device of claim 9, wherein said rear portion (21) is inclined with respect to said detachably-mounted plate part (20) to guide particles retained upon said filter (26) to slide down to said plate (20).

15. Device for setting up central vacuum cleaning installations, comprising a housing (6) structured and arranged to both contain and secure a mobile vacuum cleaner (7) therewithin and allow the vacuum cleaner (7) to be removed therefrom, with the mobile vacuum cleaner (7) having an air intake inlet (22) to receive a suction hose (8) coupled thereto, an exhaust air outlet (23) and at least one particle separator situated therewithin to remove particles from incoming air suctioned through the air intake inlet (22) prior to being exhausted through the exhaust air outlet (23), a detachably-mounted part (15, 19) upon said housing (6) and structured and arranged to allow the vacuum cleaner (7) to be either inserted into or removed from said housing (6) when detached therefrom and retain the vacuum cleaner (7) within said housing (6) when mounted thereon, a first aperture (25) arranged through said housing (6) to allow either the suction hose (8) or a connection therefor to be lead therethrough and coupled to the air intake inlet (22) of the vacuum cleaner (7) when the vacuum cleaner (7) is situated within said housing, (6), and a second opening (50) arranged through said housing (6) to direct air exhausted through the exhaust air outlet (23) of the vacuum cleaner (7) out of said housing (6) when the vacuum cleaner (7) is both operated and situated within said housing (6), wherein said housing (6) comprises a single interior containing said vacuum cleaner (7) and is distinct from an outer container (1) in which said housing (6) is positioned or forms a part of.

16. The device of claim 15, wherein said housing (6) is removably positioned within the outer container (1) to be removable therefrom and re-positioned therein with said vacuum cleaner (7) contained within said housing (6).

17. The device of claim 15, wherein said second opening (50) is positioned directly above the exhaust air outlet (23) when the vacuum cleaner (7) is positioned within said housing (6).

* * * * *